United States Patent [19]

Flockenhaus et al.

[11] 4,407,699

[45] Oct. 4, 1983

[54] PROCESS AND APPARATUS FOR THE DRY COOLING OF COKE

[75] Inventors: Claus Flockenhaus; Dietrich Wagener; Erich Hackler; Stefan Smieskol; Manfred Galow, all of Essen; Joachim Meckel, Heiligenhaus; Dieter Breidenbach, Waltrop, all of Fed. Rep. of Germany

[73] Assignee: Didier Engineering GmbH, Essen, Fed. Rep. of Germany

[21] Appl. No.: 320,742

[22] Filed: Nov. 12, 1981

[30] Foreign Application Priority Data

Nov. 28, 1980 [DE] Fed. Rep. of Germany ..... 304489

[51] Int. Cl.[3] ..... C10B 27/00; C10B 39/02

[52] U.S. Cl. ..... 201/39; 201/41; 202/228; 202/270

[58] Field of Search ..... 201/39, 41; 202/228, 202/270

[56] References Cited

U.S. PATENT DOCUMENTS

| | | | |
|---|---|---|---|
| 3,774,315 | 11/1973 | Schmalfeld et al. | 202/228 |
| 4,076,593 | 2/1978 | Koizumi et al. | 202/228 |
| 4,141,795 | 2/1979 | Koizumi et al. | 202/228 |
| 4,178,696 | 12/1979 | Beckmann et al. | 202/228 |
| 4,211,607 | 7/1980 | Privalov et al. | 202/228 |
| 4,328,072 | 5/1982 | Pries et al. | 202/228 |
| 4,338,160 | 7/1982 | Delessard et al. | 202/228 |
| 4,342,626 | 8/1982 | Jakobi et al. | 202/228 |

FOREIGN PATENT DOCUMENTS

| | | | |
|---|---|---|---|
| 3000808 | 7/1981 | Fed. Rep. of Germany | 201/39 |

*Primary Examiner*—Bradley Garris

*Attorney, Agent, or Firm*—Wenderoth, Lind & Ponack

[57] ABSTRACT

A process and apparatus for the dry cooling of coke involves the provision of a vessel having therein first and second zones in full communication with each other. Hot coke from a coking operation is introduced into the first zone and is passed through the first and second zones. Raw coke oven gas from the coking operation is introduced into the first zone, thereby reducing the temperature of the coke, while cleaning the raw coke oven gas to form cleaned coke oven gas. The cleaned coke oven gas is removed from the first zone, cooled, and then directly or indirectly utilized as a heat carrier gas introduced into the second zone to therein further reduce the temperature of the coke. The thereby further cooled coke is removed from the second zone.

18 Claims, 3 Drawing Figures

PROCESS AND APPARATUS FOR THE DRY COOLING OF COKE

BACKGROUND OF THE INVENTION

The present invention is directed to a process and apparatus for the dry cooling or quenching of coke, for example coke produced during a coking operation involving the formation of coke from preheated coal, whereby the hot coke is cooled in two zones. That is, the hot coke is cooled in a first zone by means of the crude or raw coke oven gas generated during the coking operation to form the coke. During this first cooling step, the raw coke oven gas is cleaned by the hot coke. After this first cooling step, the coke is further cooled in a second zone by means of a heat carrier gas.

This general type of process and apparatus have been proposed in West German patent application No. P 30 00 808.3-24. In this proposal two treatment zones, i.e. a cleaning zone and a cooling zone are provided as two stages and are mechanically separated from each other by a lock which creates a substantially gas-tight separation between the two zones. This separation however can impede the continuity of the coke cooling operation. The heat carrier gas for the second zone may be the flue gas from a coking furnace and or an inert gas which is totally separate from the overall coking operation, such as blast furnace gas. Accordingly, in this proposal it is necessary to provide an additional source of gas to carry out the coke cooling operation.

U.S. Pat. No. 3,895,448 discloses a dry coke cooling operation carried out in a reactor or vessel having two zones which are in full and open communication with each other. A circulating gas which operates as a heat carrier gas and a cooling gas is introduced into the transitional area between the two zones of the vessel. It would not be possible to employ the system of this U.S. patent to achieve the cleaning of the raw coke oven gas intended in the above West German patent application.

SUMMARY OF THE INVENTION

With the above discussion in mind, it is an object of the present invention to provide a process and apparatus for dry cooling of coke, whereby it is possible to overcome the prior art disadvantages.

It is a further object of the present invention to provide such a process and apparatus which improves upon prior systems and provides an effective utilization of the sensible heat of the crude or raw coke oven gas produced during a coking operation and which further provides an effective cleaning of such raw coke oven gas. It is to be understood that in accordance with the present invention, the term "cleaning" of the raw coke oven gas refers to the removal of components such as tar, sulfur, benzene, naphthalene, etc. from the raw coke oven gas as it emerges from a coking operation involving the production of hot coke. These components are converted and/or absorbed during conduction of the raw coke oven gas through the hot coke bed, and thereby are removed from the coke oven gas to form "cleaned" coke oven gas. It is believed that those skilled in the art will understand, given a particular quality of coke, what components are removed and the manner in which such removal is achieved by the hot coke bed.

It is an even further object of the present invention to provide such a process and apparatus which achieves the above advantages in a simple and reliable manner.

These objects are achieved in accordance with the present invention by the provision of a process and apparatus for the dry cooling of coke, wherein a vessel has therein first and second zones in full communication with each other. Although the present invention is particularly advantageously contemplated for the dry cooling of coke produced during a coking operation employing preheated coal, it is to be understood that the present invention is generally applicable to the dry cooling of hot coke produced in any conventional coking operation involving the production of crude or raw coke oven gas. Hot coke from the coking operation is introduced into the first zone of the vessel and is passed sequentially through the first and second zones. Raw coke oven gas from the coking operation is introduced into the first zone, thereby reducing the temperature of the coke by means of the raw coke oven gas, while simultaneously achieving cleaning of the raw coke oven gas to form cleaned coke oven gas. The cleaned coke oven gas is removed from the first zone. Heat is removed from the cleaned coke oven gas, which is then directly or indirectly utilized as a heat carrier gas introduced into the second zone to therein further reduce the temperature of the coke. The thus further cooled coke is removed from the second zone.

In accordance with the present invention, the hot coke is dry cooled while passing through the first and second zones in a continuous, or if desired semi-continuous, manner. The coke is passed generally downwardly through the first and second zones, while the raw coke oven gas and heat carrier gas are passed generally upwardly in a direction countercurrent to the passage of the coke.

In accordance with one embodiment of the present invention, at least a portion of the removed cleaned coke oven gas is combusted in a combustion chamber to form an inert gas, and this inert gas is introduced into the second zone as the heat carrier gas. The inert gas, after further cooling the coke in the second zone, is withdrawn from the vessel and may be introduced into the combustion chamber.

In accordance with a further embodiment of the present invention, the cleaned coke oven gas, after the removal of heat therefrom, is introduced directly into the second zone as the heat carrier gas.

In accordance with a further feature of the present invention, the raw coke oven gas is introduced into the first zone from the top of the vessel, the cleaned coke oven gas is removed from the first zone through a first annular channel in the jacket of the vessel, the heat carrier gas is introduced into the second zone from the bottom of the vessel, and the heat carrier gas is removed from the second zone through a second annular channel in the jacket of the vessel at a location spaced below the first annular channel. In a modified arrangement, both the cleaned coke oven gas and the heat carrier gas may be removed from the interior of the vessel through a single annular channel in the jacket of the vessel.

In accordance with a further aspect of the present invention, the heat carrier gas, after the passage thereof through the coke in the second zone, is removed from the interior of the vessel, heat is removed from the thus withdrawn heat carrier gas, and then at least a portion of the thus cooled heat carrier gas is reintroduced into the second zone.

The pressure in the second zone is preferably maintained slightly higher than the pressure in the first zone.

Additionally, tarry, benzol-containing and/or naphthalene-containing components may be removed from the raw coke oven gas before the introduction thereof into the first zone.

In accordance with the present invention, an additional source of gas is not required as the heat carrier gas to achieve the second cooling step, since the coke oven gas is itself employed, either directly or indirectly, as the heat carrier gas. The process of the present invention may be carried out in a continuous and simple manner with the first, upper zone functioning predominantly as a cleaning zone, although achieving cooling, and with the second, lower zone functioning essentially as a cooling zone. The two zones are completely open to each other, thereby enabling the coke to continuously flow from the top to the bottom of the vessel due to gravity, and such continuous flow need not be interrupted to carry out the process. A further advantage of the present invention involves the full utilization of the sensible heat from the coking operation, an advantage which is not possible with known processes coupling the operation of dry coke cooling with the operation of coal preheating.

A sufficiently high coke layer is defined between the two zones, owing to the distance between the two annualar channels, thereby largely preventing the transition of the gas from one zone to the other zone due to pressure loss. However, as indicated above, a single annular channel can be used for removing both gases from the two zones when the cleaned coke oven gas is used as the heat carrier gas. Preferably, as indicated above, the pressure in the lower zone is kept at a slightly higher level than the pressure in the upper zone so that if there occurs any transition of the gas from one zone to the other zone, such transition will be of the heat carrier gas from the lower zone to the upper zone, but not of raw coke oven gas from the upper zone into the lower zone. Furthermore, as indicated above, it is possible to remove tarry, benzol-containing and/or naphthalene-containing components from the raw coke oven gas before the introduction thereof into the upper zone.

BRIEF DESCRIPTION OF THE DRAWINGS

Other objects, features and advantages of the present invention will be apparent from the following detailed description, with reference to the accompanying drawings, wherein.

DETAILED DESCRIPTION OF THE INVENTION

Figure 1:
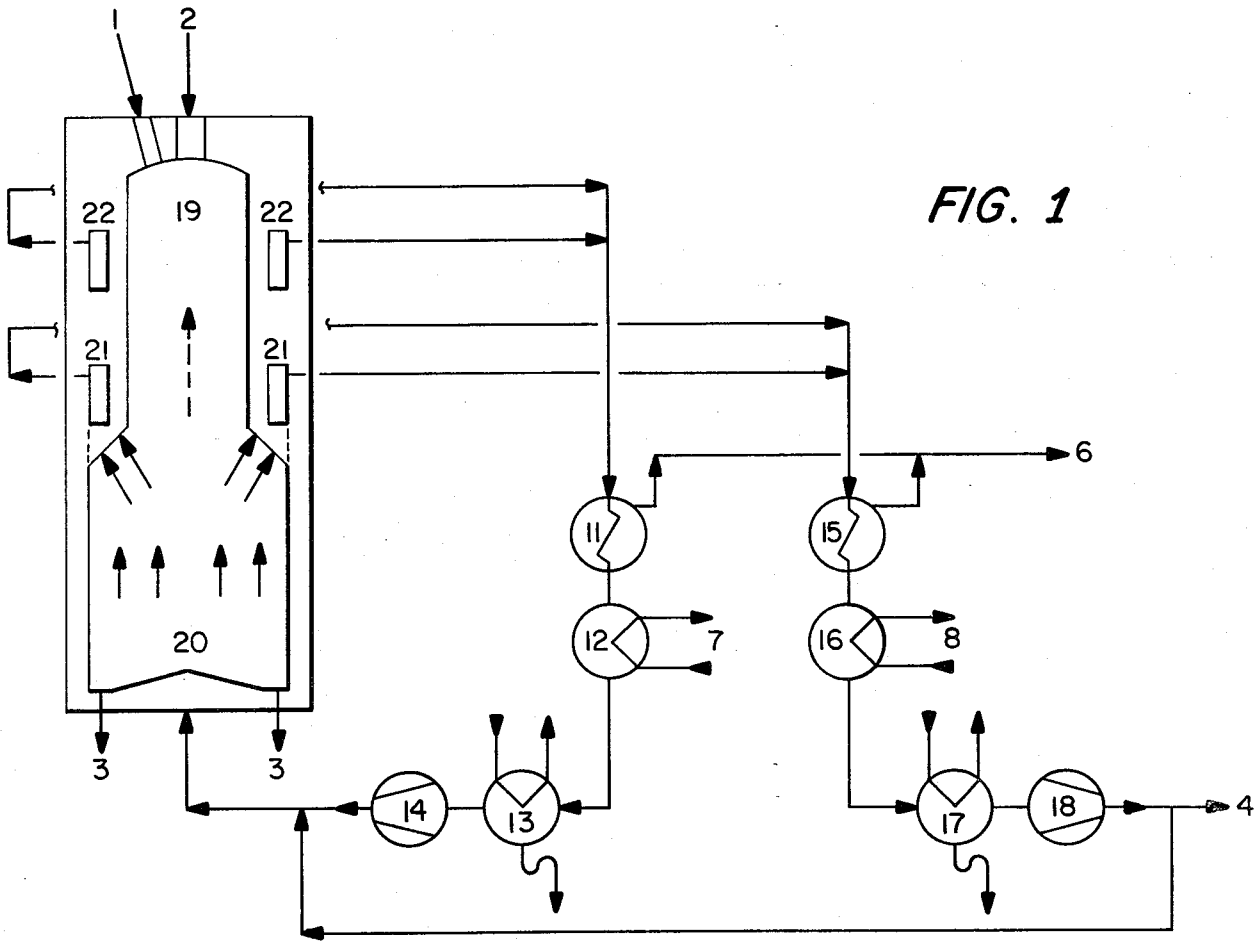
FIG. 1 is a schematic view illustrating a first embodiment of the present invention.

With reference to FIG. 1, therein is schematically illustrated a vessel or reactor for receiving and dry cooling hot coke. Hot coke received from a coke producing operation is charged through upper opening 1 into an upper zone 19 of the vessel. The coke passes continuously or semi-continuously downwardly through the interior of the vessel from upper zone 19 to a lower zone 20 and is then removed through outlets 3. Upper and lower zones 19 and 20 are completely open to each other and in full communication with each other.

Raw coke oven gas from a coking operation, wherein the hot coke is formed for example in a conventional coke oven from preheated coal, is introduced through upper opening 2, at a temperature of approximately 700° C., into first zone 19. Zone 19 of the vessel is of a size such that the necessarily intermittent charging as well as short operational interruptions can be absorbed or made up for throughout the vessel. The raw coke oven gas passes through the hot coke in upper zone 19 and thereby reduces the temperature of the coke. Simultaneously, passage of the raw coke oven gas through the coke cleans the raw coke oven gas to form cleaned coke oven gas. Such cleaned coke oven gas is withdrawn from first zone 19 at a temperature of approximately 850° to 900° C. through an upper, first annular channel 22 in the jacket of the vessel.

This cleaned coke oven gas is led through a steam boiler 11, thereby creating steam which is led off through a line 6 and then through a feed water preheater 12, thereby preheating feed water which is led to the steam boiler 11 through a line 7. This utilizes the sensible heat of the cleaned coke oven gas. From preheater 12, the thus cooled cleaned coke oven gas is passed through a water cooling stage 13 and is then compressed in a compressor 14 to a pressure of approximately 50 to 100 mbar, after which it is reintroduced into the vessel, and specifically into the lower zone 20 thereof. The thus returned cleaned coke oven gas is in this manner employed as a heat carrier gas to further reduce the temperature of the coke in the second zone 20. The coke is thus cooled down to a temperature of approximately 200° C. in zone 20. The heat carrier gas is then withdrawn from the interior of the vessel through a second annular channel 21 which is arranged at a location spaced below the first annular channel 22. Annular channels 21 and 22 are shown schematically only and may be in the form of known conventional such structures, for example as illustrated in U.S. Pat. No. 3,895,448.

The thus removed heat carrier gas is supplied to a steam boiler 15 for the further utilization of the sensible heat of the coke. Steam developed in boiler 15 is also led off through line 6. The heat carrier gas is then passed through a feed water preheater 16 to preheat feed water which is led off through line 8 to boiler 15. The heat carrier gas is then cooled in a cooler 17 and compressed in an additional compressor 18. The thus compressed heat carrier gas may then partially be returned as new heat carrier gas introduced into the lower zone 20. This partial return of the heat carrier is expedient in order to be able to dissipate or utilize the entire sensible heat of the hot coke. The portion of the compressed heat carrier gas which is not returned to the lower zone 20 as new heat carrier gas is led off through a line 4.

It is to be understood that the above described elements 11, 12, 15 and 16 are only one example of structure for utilizing the sensible heat, and other structures will be apparent to those skilled in the art. For example, the sensible heat could be employed in a coal preheating system.

Figure 2:
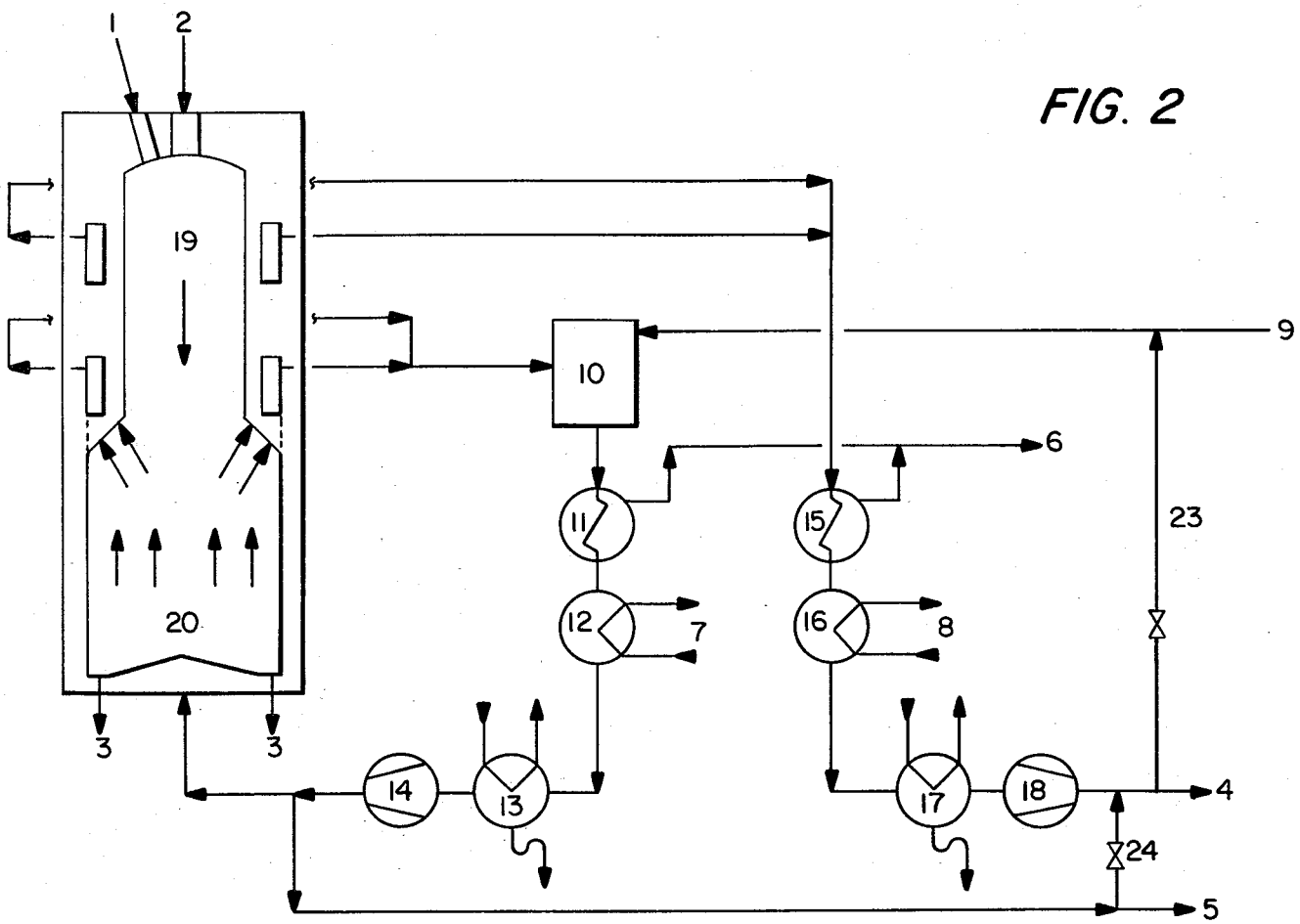
FIG. 2 is a schematic view illustrating a second embodiment of the present invention.

With reference now to FIG. 2, a further embodiment of the present invention will be described. The system illustrated in FIG. 2 differs from that of FIG. 1 in that an inert gas is used as the heat carrier gas in lower zone 20. The inert gas is produced in a combustion chamber 10 by the stoichiometric combustion of a combustible gas supplied through line 9. Preferably, this is at least a partial flow of the cleaned coke oven gas. The sensible heat of the thus generated inert gas can be utilized in steam boiler 11 and feed water preheater 12, in a manner discussed above regarding FIG. 1. Cleaned coke oven gas is withdrawn from upper zone 19 of the vessel through upper annular channel 22 and is led through boiler 15 and feed water preheater 16, in a manner similar to the above description of FIG. 1, thereby utilizing the sensible heat of the cleaned coke oven gas. This cleaned coke oven gas, after being cooled in cooler 17 and compressed in compressor 18, may be led off through line 4 or may be at least partially returned to line 9 through connecting line 23 to be burned in combustion chamber 10 and thereby be indirectly employed as the heat carrier gas introduced into lower zone 20.

Since slightly more gas is subsequently extracted from the coke in the vessel and the produced inert gas cannot be totally inert, some reactions still take place in the lower zone 20 concerning the hot coke which may make it necessary to constantly lead off some inert gas from the cycle as exhaust gas through a line 5. To the same extent, fresh inert gas is to be supplied to the cycle. This exhaust gas which has a heating value of 1500 to 2000 $KJ/mn^3$ can also be added to the cleaned and cooled coke oven gas of line 4 through a line 24.

Figure 3:
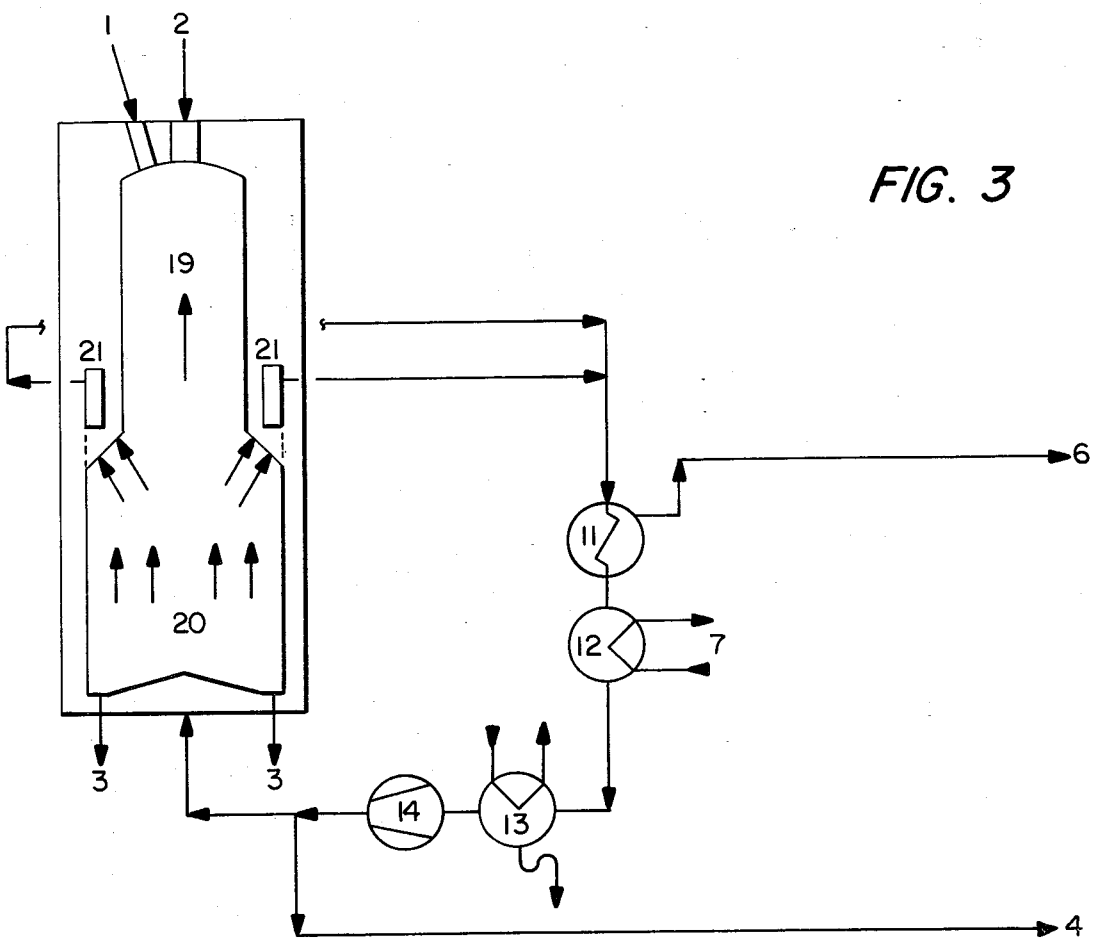
FIG. 3 is a schematic view illustrating a third embodiment of the present invention.

With reference now to FIG. 3 of the drawings, a further embodiment of the present invention will be described. The system of FIG. 3 differs from the system of FIG. 1 in that the cleaned coke oven gas from upper zone 19 and the heat carrier gas, in the form of coke oven gas removed from lower zone 20, are both withdrawn through a single common annular channel 21 located in the transition area between zones 19 and 20 of the jacket of the vessel. A portion of this removed combined gas is returned into lower zone 20 as the heat carrier gas after passing through steam boiler 11, feed water preheater 12, water cooler 13 and compressor 14. A portion of the withdrawn and combined gas is led out of the system through line 4. The arrangement of FIG. 3 leads to an obvious simplification of the system.

Although the present invention has been described and illustrated with respect to preferred embodiments thereof, it is to be understood that various modifications and changes may be made thereto without departing from the scope of the present invention. Furthermore, it is to be understood that various features of the three illustrated embodiments may be combined as will be apparent to those skilled in the art.

We claim:

1. A process for the dry cooling of coke produced during a coking operation which also produces raw coke oven gas, said process comprising:

providing a vessel having therein first and second zones in full communication with each other;

introducing hot coke into said first zone, and passing said coke through said first and second zones without adding heat to said coke;

introducing raw coke oven gas from the coking operation into said first zone and therein reducing the temperature of said coke by means of said raw coke oven gas, while cleaning said raw coke oven gas to form cleaned coke oven gas;

removing said cleaned coke oven gas from said first zone;

removing heat from the thus removed cleaned coke oven gas;

and therein further reducing the temperature of said coke by means of said heat carrier gas; and removing the thus further cooled coke from said second zone.

2. A process as claimed in claim 1, comprising passing said coke downwardly through said first and second zones.

3. A process as claimed in claim 1 or claim 2, comprising passing said heat carrier gas through said coke generally countercurrent to the direction of passage of said coke through said second zone.

4. A process as claimed in claim 1, comprising combusting at least a portion of said removed cleaned coke oven gas in a combustion chamber to form an inert gas, and introducing said inert gas into said second zone as said heat carrier gas.

5. A process as claimed in claim 4, comprising withdrawing said inert gas from said vessel and introducing the thus withdrawn inert gas into said combustion chamber.

6. A process as claimed in claim 1, comprising introducing said cleaned coke oven gas, after the removal of heat therefrom, directly into said second zone as said heat carrier gas.

7. A process as claimed in claim 4 or claim 6, comprising introducing said raw coke oven gas into said first zone from the top of said vessel, removing said cleaned coke oven gas from said first zone through a first annular channel in the jacket of said vessel, introducing said heat carrier gas into said second zone from the bottom of said vessel, and withdrawing said heat carrier gas from said second zone through a second annular channel in said jacket of said vessel at a location spaced below said first annular channel.

8. A process as claimed in claim 4 or claim 6, comprising introducing said raw coke oven gas into said first zone from the top of said vessel, introducing said heat carrier gas into said second zone from the bottom of said vessel, and removing both said cleaned coke oven gas and said heat carrier gas from the interior of said vessel through a single annular channel in the jacket of said vessel.

9. A process as claimed in claim 1, further comprising withdrawing said heat carrier gas, after the passage thereof through said coke in said second zone, from the interior of said vessel, removing heat from the thus withdrawn heat carrier gas, and then reintroducing at least a portion of the thus cooled heat carrier gas into said second zone.

10. A process as claimed in claim 1, further comprising maintaining the pressure in said second zone slightly higher than the pressure in said first zone.

11. A process as claimed in claim 1, further comprising removing tarry, benzol-containing and naphthalene-containing components from said raw coke oven gas before the introduction thereof into said first zone.

12. An apparatus for the dry cooling of coke, for example coke produced during a coking operation employing preheated coal and producing raw coke oven gas, said apparatus comprising:

a vessel having therein first and second zones in full communication with each other;

means for introducing hot coke into said first zone and passing said coke through said first and second zones without adding heat to said coke;

means for introducing raw coke oven gas from a ing said raw coke oven gas to form cleaned coke oven gas;

means for removing said cleaned coke oven gas from said first zone;

means for removing heat from the thus removed cleaned coke oven gas;

means for directly or indirectly utilizing the thus cooled cleaned coke oven gas as a heat carrier gas and introducing said heat carrier gas into said second zone and thereby further reducing the temperature of said coke; and means for removing the thus further cooled coke from said second zone.

13. An apparatus as claimed in claim 12, wherein said utilizing means comprises combustion chamber means for combusting at least a portion of said removed cleaned coke oven gas and for thereby forming an inert gas as said heat carrier gas.

14. An apparatus as claimed in claim 13, further comprising means for withdrawing said inert gas from said vessel and for introducing the thus withdrawn inert gas into said combustion chamber means.

15. An apparatus as claimed in claim 12, wherein said utilizing means comprises means for introducing said cleaned coke oven gas, after the removal of heat therefrom, directly into said second zone as said heat carrier gas.

16. An apparatus as claimed in claim 13 or claim 15, wherein said raw coke oven gas introducing means is at a top portion of said vessel, said cleaned coke oven gas removing means comprises a first annular channel in the jacket of said vessel, said heat carrier gas introducing means is at a bottom portion of said vessel, and further comprising a second annular channel in said jacket of said vessel at a location spaced below said first annular channel for withdrawing said heat carrier gas from said second zone.

17. An apparatus as claimed in claim 13 or claim 15, wherein said raw coke oven gas introducing means is at a top portion of said vessel, said heat carrier gas introducing means is at a bottom portion of said vessel, and said cleaned coke oven gas removing means comprises a single annular channel in the jacket of said vessel, said single annular channel also comprising means for withdrawing said heat carrier gas from said second zone.

18. An apparatus as claimed in claim 12, further comprising means for withdrawing said heat carrier gas, after the passage thereof through said coke in said second zone, from the interior of said vessel, means for removing heat from the thus withdrawn heat carrier gas, and means for reintroducing at least a portion of the thus cooled heat carrier gas into said second zone.

* * * * *